US006311516B1

(12) United States Patent
Key et al.

(10) Patent No.: US 6,311,516 B1
(45) Date of Patent: Nov. 6, 2001

(54) PROCESS AND APPARATUS FOR $C_3$ RECOVERY

(76) Inventors: Ronald D. Key; Steven C. Brantingham, both of 8522 E. 61st St., Tulsa, OK (US) 74133

( * ) Notice: Subject to any disclaimer, the term of this patent is extended or adjusted under 35 U.S.C. 154(b) by 0 days.

(21) Appl. No.: 09/492,189

(22) Filed: Jan. 27, 2000

(51) Int. Cl.[7] ..... F25J 3/00
(52) U.S. Cl. ..... 62/619
(58) Field of Search ..... 62/619, 620

(56) References Cited

U.S. PATENT DOCUMENTS

| | | | | |
|---|---|---|---|---|
| 3,785,161 | * | 1/1974 | Hart et al. | 62/23 |
| 4,040,259 | * | 8/1977 | Zahn et al. | 62/37 |
| 5,799,507 | * | 9/1998 | Wilkinson et al. | 62/621 |
| 5,899,377 | * | 4/1999 | Foglietta | 62/621 |

* cited by examiner

*Primary Examiner*—William Doerrler
*Assistant Examiner*—Malik N. Drake

(74) *Attorney, Agent, or Firm*—William S. Dorman

(57) ABSTRACT

An improved process for separating a hydrocarbon bearing feed gas containing methane and lighter, $C_2$ (ethylene and/or ethane), $C_3$ (propylene and/or propane) and heavier components into a fraction containing predominantly $C_2$ and lighter components and a fraction containing predominantly $C_3$ and heavier hydrocarbon components including the steps of cooling and partially condensing and delivering the feed stream to a separator to provide a first residue vapor and a $C_3$ containing liquid, directing a portion of the $C_3$ containing liquid into a heavy-ends fractionation column wherein the liquid is separated into a second hydrocarbon bearing vapor residue, a second $C_2$ containing liquid stream, and a $C_3$ containing product. Directing part of the second liquid into the lights-ends fractionation column, which liquid provides additional liquefied $C_2$'s which act as a direct contact refrigerant to thereby condense $C_3$'s and heavier components while the $C_2$'s are evaporated in the light-ends fractionation column to thereby obtain third residue vapors and liquids, supplying the liquids recovered from the light-ends fractionating column to the heavy-ends fractionation column as a feed thereto.

14 Claims, 4 Drawing Sheets

PROCESS AND APPARATUS FOR $C_3$ RECOVERY

BACKGROUND OF THE INVENTION

1. Field of the Invention

This invention relates to an improved process for separating a hydrocarbon-bearing feed gas which contains methane and lighter components, (not necessarily all hydrocarbon components), $C_2$ (ethylene and ethane), $C_3$ (propylene and propane), and heavier hydrocarbon components into two fractions. The first fraction contains predominantly $C_2$'s and lighter components and the second fraction contains the recovered desirable $C_3$ and heavier components. More particularly, this invention relates to a process and apparatus wherein the yield of C3's is increased.

2. The Prior Art

Hydrocarbon-bearing gas may contain lighter components (e.g., hydrogen, nitrogen, etc.) methane, ethane, and/or ethylene, and a substantial quantity of hydrocarbons of higher molecular weight, for example, propane, butane, pentane and often their unsaturated analogs. Recent changes in propylene/propane demand have created increased markets for propylene/propane and have created a need for more efficient processes which yield higher recovery levels of this product. In more recent times, the use of cryogenic processes utilizing the principle of gas expansion through a mechanical device to produce power while simultaneously extracting heat from the system have been employed. The use of such equipment depends upon the pressure of the gas source, the composition of the gas and the desired end results. In the typical cryogenic expansion-type recovery processes used in the prior art, a gas stream under pressure is cooled by heat exchange with other streams of the process and/or external sources of cooling are employed such as refrigeration systems. As the gas is cooled, liquids are condensed and are collected and separated so as to thereby obtain desired hydrocarbons. The high pressure liquid feed is typically transferred to a deethanizer column after the pressure is adjusted to the operating pressure of the deethanizer. In such fractionating column the liquid feed is fractionated to separate the residual ethylene/ethane and lighter components from the desired products of propylene/propane and heavier hydrocarbon components. In the ideal operation of such separation processes, the vapors leaving the process contain substantially all of the ethylenelethane and lighter components found in the feed gas and substantially no propylene/propane or heavier hydrocarbon components remain. The bottom fraction leaving the deethanizer typically contains substantially all of the propylene/propane and heavier hydrocarbon components with very little ethylenelethane or lighter components which is discharged in the fluid gas outlet from the deethanizer.

A patentability search was conducted on the present invention and the following references were uncovered.

| Inventor | U.S. Pat. No. | Issue Date |
|---|---|---|
| Harandi | 4,664,784 | 5/12/1987 |
| Buck et al | 4,895,584 | 1/23/1990 |
| Campbell et al | 5,771,712 | 9/01/1998 |
| Wilkinson et al | 5,699,507 | 6/30/1998 |

U.S. Pat. No. 4,664,784—Issued May. 12, 1987
M. N. Harandi to Mobil Oil Corporation In a reference directed to fractionation of hydrocarbon mixtures, teachings are found on column 4, line 32 et sequitur re: a zone (81) wherein a descending liquid heavy-ends portion contacts an ascending vaporous light-ends portion so as " . . . to aid in heat transfer between vapor and liquid." (column 4, line 44).

U.S. Pat. No. 4,895,584—Issued Jan. 23, 1990
L. L. Buck et al to Pro-Quip Corporation A reference that claims an improved process for hydrocarbon separation and teaches supplying of the liquids recovered from the light-ends fractionating column to the heavy ends fractionating column and directing part of the (C2 containing) liquid from a first step into intimate contact with a second residue, which liquid provides additional liquefied methane which acts with the partially condensed second residue as a direct contact refrigerant to thereby condense C2 and heavier comprising hydrocarbons while methane itself is evaporated in the light-ends fractionating column.

On column 1, lines 56–67 the following teachings are found: " . . . feed gas is first cooled and partially condensed and delivered to a separator to provide a first residue vapor and a C2 containing liquid . . . Part of the C2 containing liquid from the separator may be directed into a heavy ends fractionating column wherein the liquid is separated into a second residue containing lighter hydrocarbons and C2 containing products. A part of the first residue vapors with at least part of the partially condensed second residue are counter currently contacted and co-mingled in a light ends fractionating column (emphasis added) . . . "

On column 2, lines 1–10 the following teachings are found: "The liquids recovered from the light-ends fractionating column are then fed to the heavy-ends fractionating column as a liquid feed. A portion of the C2 containing liquids from the separator is fed into intimate contact with the second residue prior to discharging the co-mingled liquids and gases into the light-ends fractionating column to thereby achieve mass and heat transfer (emphasis added) to thereby liquefy a higher percent of the C2 and heavier hydrocarbon components while the methane is vaporized (column 2, lines 1–10).

The following Elcor Corporation references describe the recovery of C3 and heavier hydrocarbons via processes wherein counter-current contact of a stream drawn from a deethanizer with a stream in a separator/absorber takes place:

U.S. Pat. No. 5,799,507—Issued Sep. 1, 1998
J. D. Wilkinson et al to Elcor Corporation See column 4, line 2 re: ". . . liquid portion of expanded stream comingles with liquids falling downward from the absorbing section . . . " l.o.w., the stream (36) from the deethanizer (17) flows through heat exchanger (20) to become stream (36a) which flows into the upper section of separator (15) where it . . . contacts the vapors rising upward through the absorption section" (column 5, lines 3–4).

U.S. Pat. No. 5,771,712—Issued Jun. 30, 1998
R. E. Campbell et al to Elcor Corporation This reference teaches essentially the same as Wilkinson et al.

None of the foregoing patents discussed above embody the present invention.

SUMMARY OF THE INVENTION

The present invention provides processes for increasing the propylene and propane component of the liquid discharge from the process unit at reduced energy consumption than the prior art. The foregoing advantage is achieved in the present invention by a process in which the feed gas is first cooled and partially condensed and delivered to a separator to provide a first residue vapor and a $C_3$ containing liquid which liquid also contains lighter hydrocarbons. Part of the $C_3$ containing liquid from the separator may be directed into a heavy-ends fractionation column, wherein the liquid is separated into a second residue containing lighter hydrocarbons, and a $C_3$ containing product. The second residue is partially or fully condensed and delivered to a separator where a $C_2$ containing liquid is discharged. Where the second residue is only partially condensed, a fourth residue will be discharged also. A part of the $C_2$ containing liquid is further cooled before being sent to the light-ends fractionating column. The portion of the $C_2$ containing liquid that is not cooled and sent to the light-ends fractionating column is recycled back to the heavy-ends fractionating column as reflux. A part of the first residue vapors is counter-currently contacted and co-mingled with the cooled part of the $C_2$ containing liquid in a light-ends fractionating column to thereby provide third residue vapors and liquids which are separately discharged. The liquids recovered from the light-ends fractionating column are then fed to the heavy-ends fractionation column as a liquid feed. A cooled portion of the $C_2$ containing liquids is fed into the light-ends fractionating column to thereby achieve mass and heat transfer and to thereby liquefy a higher percent of the $C_3$ and heavier hydrocarbon components while the ethylene/ethane is vaporized. In this manner a higher proportion of the $C_3$ and heavier hydrocarbon components are recovered.

A better understanding of the invention will be had with reference to the following description and claims, taken in conjunction with the attached drawings.

DESCRIPTION OF THE PREFERRED EMBODIMENTS

The improved processes of the present disclosure include the steps of cooling a gaseous hydrocarbon-containing feed stream to form a vapor stream and a liquid stream. The liquid stream may be partially transferred to a heavy-ends fractionation column while the vapor stream is expanded and transferred to the bottom of a light-ends fractionation column. The heavy-ends fractionation column overhead, which consists mainly of methane, ethylene, and/or ethane, is cooled to produce a liquid. A portion of the produced liquid is used to reflux the heavy-ends fractionation column whereas the other portion is fed to the upper portion of the light-ends fractionation column. The liquid flows downwardly within the light-ends fractionation column and contacts gaseous propylene and/or propane and heavier hydrocarbons that flow upwardly. The methane and ethylene/ethane portion of the liquid stream is vaporized by absorbing heat from the gaseous propylene/propane and heavier hydrocarbons which causes the propylene/propane and heavier hydrocarbons to condense and exit at the bottom of the light-ends fractionation column. The gaseous ethylene and/or ethane and lighter components within the light-ends fractionation column are removed from the overhead as a product of the process. The liquid at the bottom of the light-ends fractionation column is removed and fed to the upper portion of the heavy-ends fractionation column. The liquid at the bottom of the heavy-ends fractionation column is removed as a product of the process.

Figure 1:
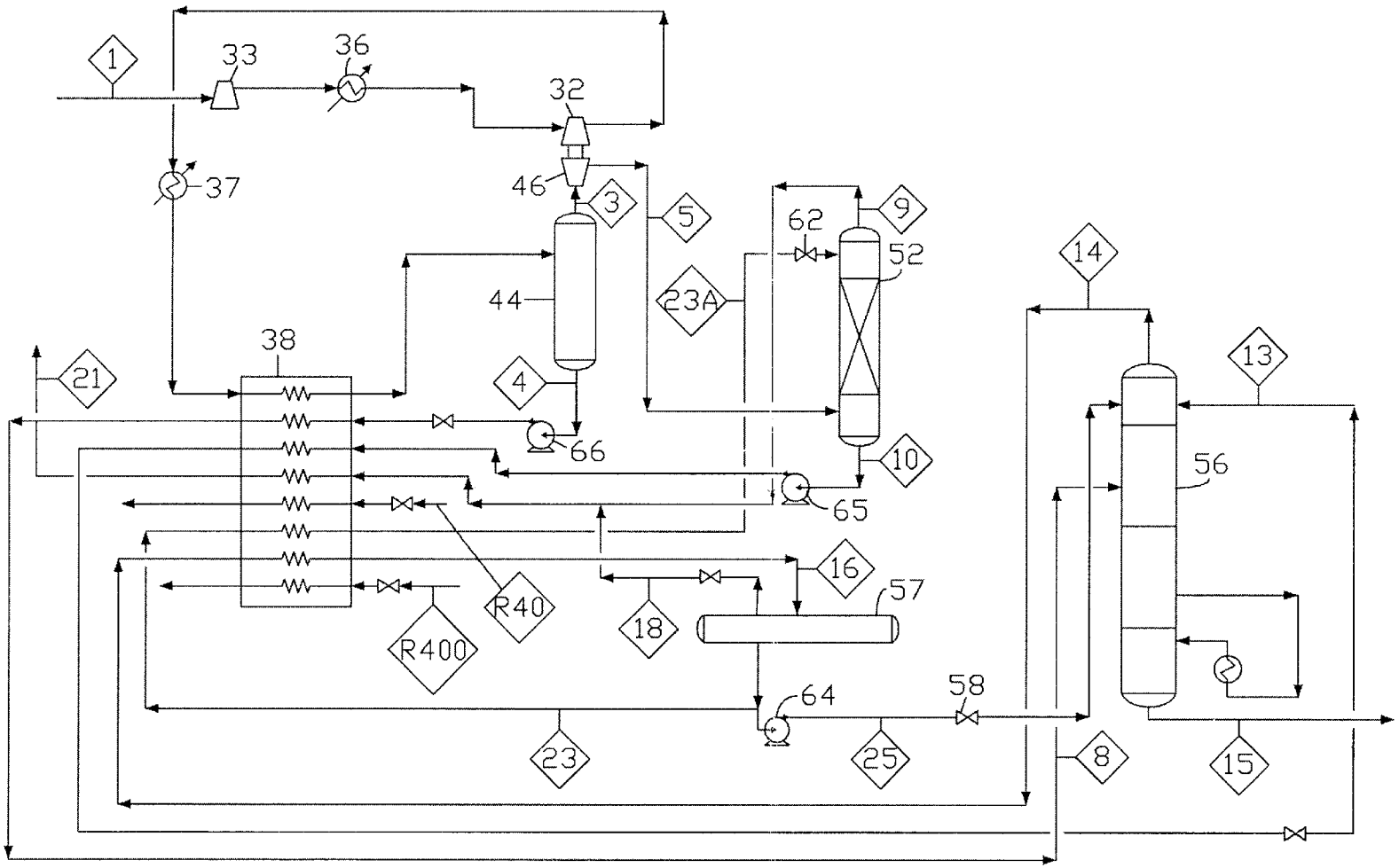
FIG. 1 is a schematic flow diagram illustrating a method of practicing a preferred embodiment of the invention.

The improved process of this invention is illustrated in a first embodiment in FIG. 1. The incoming gas stream 1 is first fed to a booster compressor 33. The compressed gas is cooled in heat exchanger 36 and the output thereof to a second booster compressor 32.

The stream then flows through a heat exchanger 37. The gas exits from the heat exchanger 37 at a temperature of 102° F., but the pressure thereof has been raised to 305 psia. The gas then passes through heat exchanger 38, so that the temperature thereof is reduced to about −30° F. Pressure is reduced as the gas flows through the heat exchangers resulting in a pressure of 300 psia at −30° F. at which the raw gas is delivered into a separator 44. Within separator 44 the cooled gas stream is separated into a first residue vapor which is passed through a turbo expander 46. The shaft of turbo expander 46 is connected directly to the shaft of the booster compressor 32. From the turbo expander, the first residue gas having a temperature of about −79° F. at 125 psia passes by way of stream 5 into a light ends fractionating column 52.

From the separator 44, by way of stream 4, the $C_3$ containing liquid is channeled through heat exchanger 38 where its temperature is increased to 60° F. and exits heat exchanger 38 as stream 8. The liquid, by way of stream 8, is then conducted into a heavy ends fractionation column 56.

The off-gas from heavy ends fractionation column 56, having a temperature of about 21° F., is fed by stream 14 through heat exchanger 38 and by way of stream 16 into the reflux separator 57. At least a portion of the liquid residue from the reflux separator 57 is routed by stream 23 through heat exchanger 38 where its temperature is reduced to −100° F. at a pressure of 290 psia. This liquid stream is then passed by the stream 23A into the light ends fractionating column 52. The liquid from stream 23A passes downwardly through the light ends fractionating column 52 and encounters the rising off gas from stream 5 so that mass and latent heat transfer occur.

The light ends fractionating column 52 functions as a combination heat and mass transfer device. The column has two feed streams; that is, streams 5 and 23A, and two product streams; that is, streams 10 and 9. The light ends fractionating column 52 consists of at least one, and preferably more, liquid-vapor equilibrium stages.

The methane, ethylene, ethane and lighter constituents and un-recovered propylene and propane, exit as a dew point vapor from the top tray or separation stage of the light ends fractionating column 52. Vapors enter by way of stream 5 as a bottom feed while the top feed is by way of stream 23A which is a liquid enriched by a condensed ethylene and ethane.

The top feed through stream 23A into the light ends fractionating column 52, and particularly the ethylene/ethane content thereof serves as a reflux in the column. In flowing from stage to stage within column 52, the liquid ethylenelethane is vaporized and in turn the liquid is progressively enriched in propylene and propane condensed from the upflowing bottom feed vapors from stream 5.

The liquid discharge from the lower end of the heavy ends fractionation column 56 is passed by way of stream 15 to product discharge.

The off-gas discharged from light ends fractionation column 52, combine with the vapors in stream 18 exiting the reflux separator 57. The combined vapors pass through heat exchanger 38 for discharge from the system. At this stage, the off-gas in stream 21 has a temperature of 97° F. and a pressure of 110 psia. If it is desired to return the discharge gas to the same system from which the raw gas was taken, such as for further transportation of the gas, the pressure will need to be raised back up to that substantially equal to the incoming pressure of 165 psia in stream 1.

A simulation of the process of FIG. 1 is set forth in Table 1 wherein the moles per hour of various constituents of the streams set forth. The process achieves a recovery of about 96.30 percent of the $C_3$ content of the feed gas in addition to substantially complete recovery of the $C_4$ and heavier hydrocarbon components of the feed gas stream.

Figure 2:
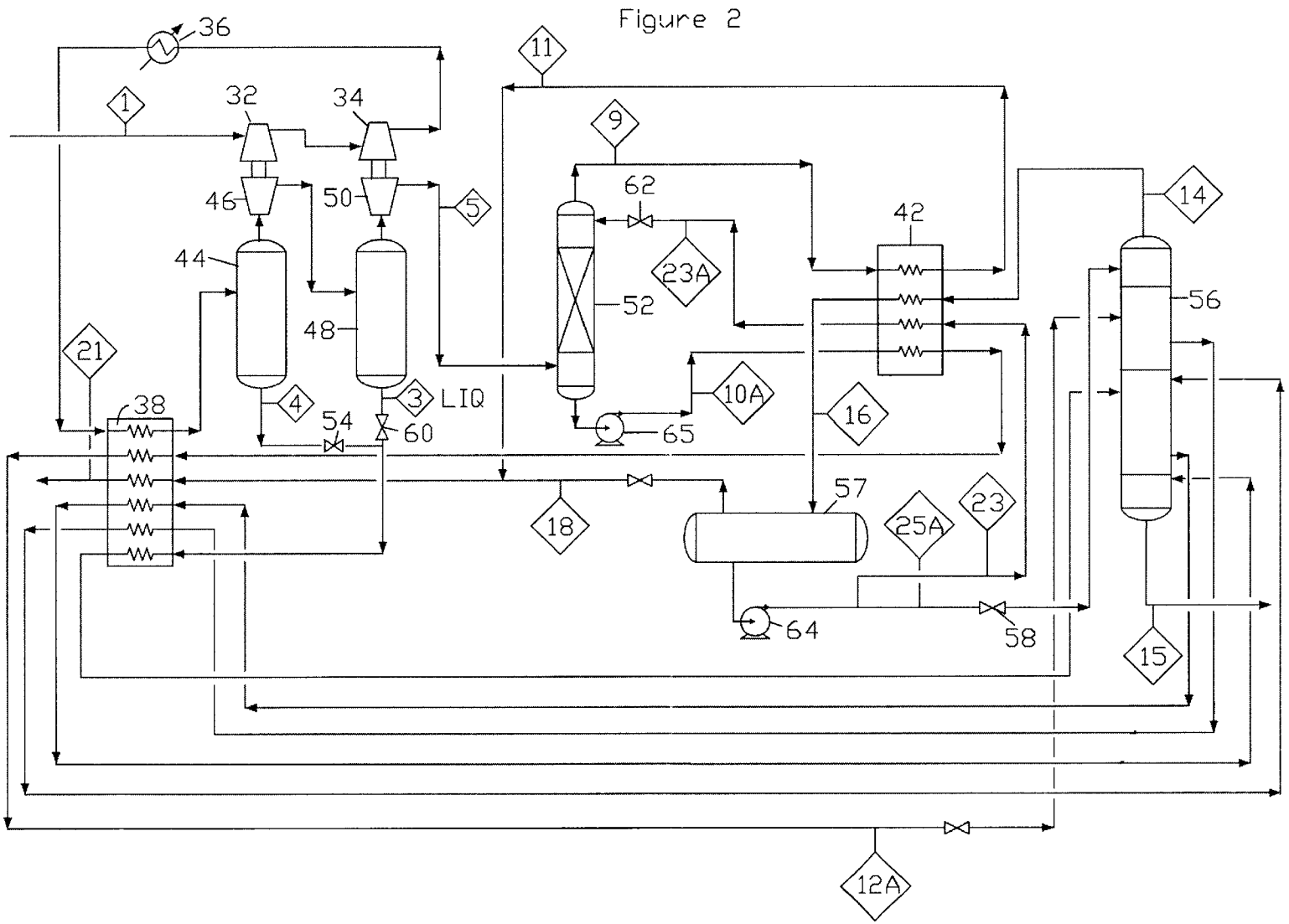
FIGS. 2 through 4 are each schematic flow diagrams illustrating variations in the preferred embodiment of the present invention.

FIG. 2 shows an alternate embodiment of the invention. The components of the process of FIG. 2 having the same basic structure and function of those of the system of FIG. 1 are given like numbers. The process is as described with reference to FIG. 1, except for the addition of a second separator 48, turbo expander 50, booster compressor 34 and the treatment of the off-gas from the heavy ends fractionation column 66. In the arrangement of FIG. 2, the off-gas, flowing through stream 14, is passed first through a heat exchanger 42 and then to the reflux separator 57. The offgas from the light ends fractionating column 52 and liquids from the light ends fractionating column pass through exchanger 42 thus providing cooling to stream 14 and stream 23. The heavy ends fractionating column off-gases exit exchanger 42 as stream 16 and flow into the reflux separator 57. The liquid stream 23A passes through heat exchanger 42 and valve 62 before discharge into the upper portion of light ends fractionating column 52. Within such column the recycled liquid portion of the effluent functions in heat exchange action with the hydrocarbon containing components of the gas passing upwardly in the fractionating column to condense and absorb at least a substantial portion of the $C_3$ and heavier hydrocarbon components. The arrangement of the FIG. 2 embodiment of the system compared to that of FIG. 1 provides an alternate method of ethylene/ethane condensation in the combined gas and effluent inserted into the upper end of the light ends fractionating column.

Table 2, which shows the moles per hour calculations of a simulation of the system of FIG. 2 provides a comparison of the contents of the various streams of this embodiment of the process compared to that of the process of FIG. 1. The process achieves a recovery of about 96.63 percent of the $C_3$ content of the feed gas in addition to substantially complete recovery of the $C_4$ and heavier hydrocarbon components of the feed gas stream.

Figure 3:
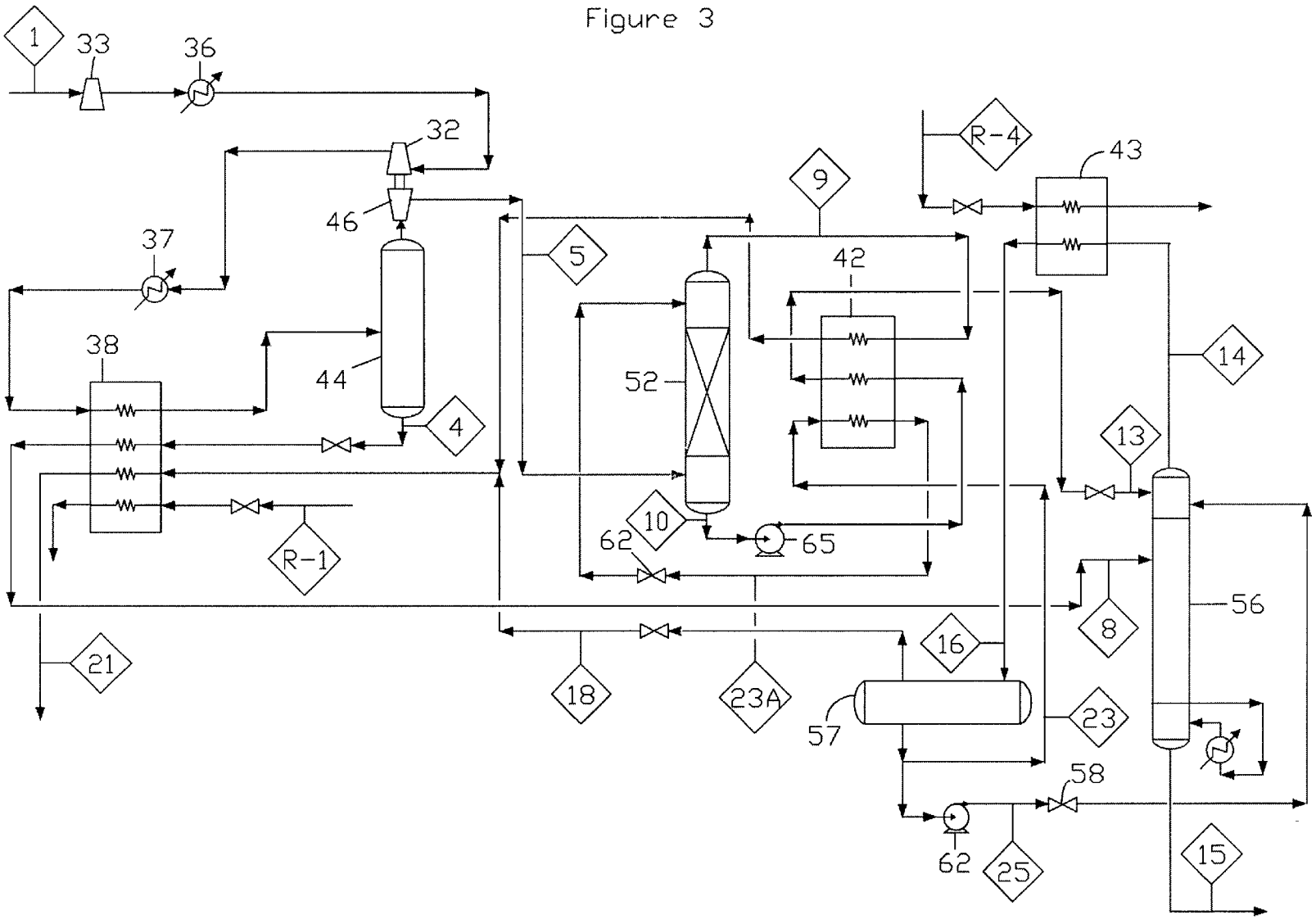

FIG. 3 illustrates another alternate embodiment of the process. In this embodiment, the off-gas from the heavy ends fractionation column is passed through a heat exchanger 43 and into reflux separator 57. The resulting condensed liquids are then separated into heavy ends fractionation column reflux and stream 23. Stream 23A is sub-cooled in heat exchanger 42 and flows via value 62 into the upper end of the light ends fractionating column 52.

Table 3 provides the molar rates of the various streams in the process of the embodiment of FIG. 3 showing the percentage recoveries of propylene and propane. The process achieves a recovery of about 97.65 percent of the $C_3$ content of the feed gas in addition to substantially complete recovery of the $C_4$ and heavier hydrocarbon components of the feed gas stream.

Figure 4:
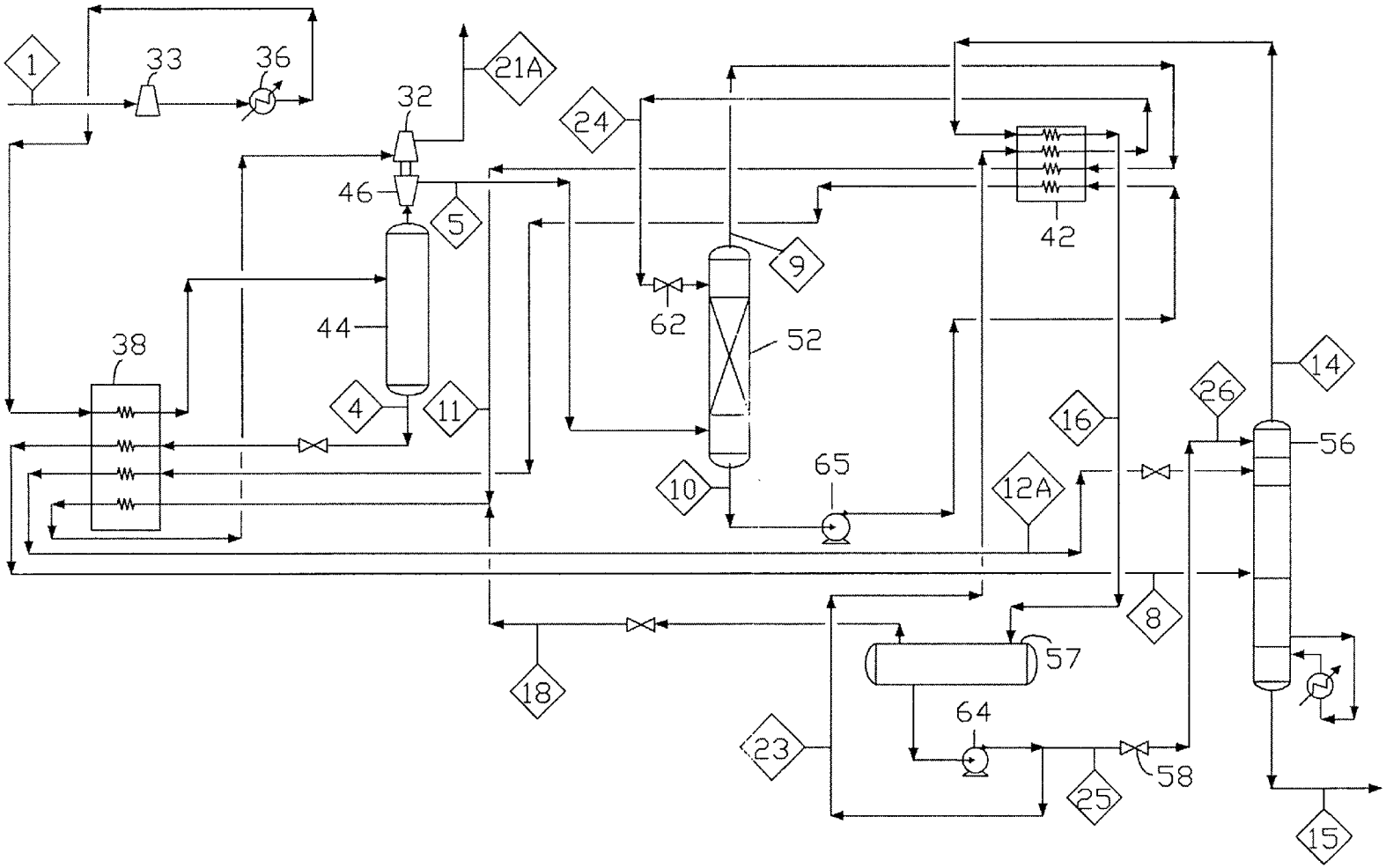

FIG. 4 shows an embodiment of the process similar to FIG. 2. This embodiment features a single turbo expander and reduced heat integration of the heavy ends fractionation column 56 with the feed heat exchanger 38. Table 4 shows the calculated moles per hour of the various streams in the embodiment of FIG. 4 and the pressure and temperature of the streams. The process achieves a recovery of about 99.08 percent of the $C_3$ content of the feed gas in addition to substantially complete recovery of the $C_4$ and heavier hydrocarbon components of the feed gas stream. The feed stream 1 in Table 4 does not contain propylene and as such reflects a composition representative of a natural gas stream.

The process has been illustrated using various standard components employed for the sequence of treating steps with it being understood that the process may be practiced utilizing different physical apparatus. For instance, the turbo expanders 46 and 50 can, in many instances, be eliminated or replaced by Joule-Thomson isenthalpic control valves. The difference is that where the expander is eliminated or where the JouleThomson valves are substituted for the turbo expanders, normally greater inlet and refrigeration compression duties are required.

Various arrangements have been shown in the alternate embodiments for cooling the second residue effluent and, in some instances, the combined residue effluent and heavy-ends fractionation column off-gas; however, it has been determined that the resultant $C_3$ recovery is essentially identical provided an equal amount of heat is removed in any of the various embodiments of the process which have been described.

Some of the illustrated processes in each instance use two turbo expanders as shown in FIG. 2. The desirability of the use of multiple turbo expanders is predicated primarily upon the amount of hydrogen content of the inlet gas in stream 1. It is understood that, according to the inlet gas content, only single turbo expanders may be employed in practicing the process; or, in some instances as previously indicated, turbo expanders may be eliminated completely or substituted by one or more Joule-Thomson isenthalpic expansion valves.

An important element of the process is employment of the light-ends fractionating column 52 which functions as a combination heat and mass transfer device. The use of the reflux in the top stage means that the liquid methane, ethylene, and ethane of the reflux is vaporized; and in turn the liquid is progressively enriched in propylene and propane condensed from the upflowing bottom feed vapors to thereby recover a higher percent of the $C_3$ components.

For a given propylene/propane recovery, the process allows reducing the pressures that were required in the first cold separator; thus reducing the inlet compression capital and operating costs compared to the prior art. The improved process of this invention as exemplified in the embodiments of FIGS. 1 through 4 achieves a given propylenelpropane recovery while requiring relatively lower inlet gas pressure and refrigeration compression horse power than with the known prior art process. Further, in the processes exemplified in FIGS. 1 through 4, the propylene/propane recovery is achieved in a manner wherein the process is operated at a higher temperature level than in the previously known processes.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

TABLE 1

| COMPONENT | STREAM NUMBER 1 | 3 | 4 | 5 | 9 | 10 | 23A | 25 | 14 | 16 | 18 | 21 | 15 | PERCENT RECOVERY |
|---|---|---|---|---|---|---|---|---|---|---|---|---|---|---|
| | MOLS/HR | | | | | | | | | | | | | |
| Hydrogen | 1161.07 | 1157.72 | 3.35 | 1157.72 | 1157.72 | 1.28 | 1.28 | 0.55 | 5.18 | 5.18 | 3.35 | 1161.07 | 0.00 | |
| Carbon Monoxide | 34.59 | 34.26 | 0.33 | 34.26 | 34.34 | 0.21 | 0.29 | 0.12 | 0.66 | 0.66 | 0.25 | 34.59 | 0.00 | |
| Nitrogen | 202.57 | 200.99 | 1.58 | 200.99 | 201.32 | 0.94 | 1.27 | 0.54 | 3.06 | 3.06 | 1.25 | 202.57 | 0.00 | |
| Oxygen | 4.94 | 4.85 | 0.09 | 4.85 | 4.89 | 0.06 | 0.10 | 0.04 | 0.19 | 0.19 | 0.05 | 4.94 | 0.00 | |
| Methane | 1630.43 | 1579.94 | 50.49 | 1579.94 | 1609.02 | 43.38 | 72.47 | 31.06 | 124.92 | 124.92 | 21.40 | 1630.42 | 0.00 | |
| Ethylene | 543.48 | 462.67 | 80.81 | 462.67 | 530.46 | 128.55 | 196.37 | 84.16 | 293.49 | 293.49 | 12.97 | 543.44 | 0.00 | 0.00% |
| Ethane | 805.33 | 616.63 | 188.70 | 616.63 | 782.40 | 386.02 | 551.88 | 236.52 | 810.75 | 810.75 | 22.35 | 804.75 | 0.43 | 0.05% |
| Propene | 281.62 | 124.31 | 157.31 | 124.31 | 9.87 | 165.36 | 50.90 | 21.81 | 73.29 | 73.29 | 0.57 | 10.44 | 271.21 | 96.30% |
| Propane | 158.10 | 62.93 | 95.17 | 62.93 | 3.21 | 80.89 | 21.17 | 9.07 | 30.44 | 30.44 | 0.20 | 3.41 | 154.69 | 97.84% |
| Iso-Butene | 9.88 | 1.47 | 8.41 | 1.47 | 0.00 | 1.61 | 0.14 | 0.06 | 0.21 | 0.21 | 0.00 | 0.00 | 9.88 | 99.96% |
| 1-Butene | 9.88 | 1.42 | 8.46 | 1.42 | 0.00 | 1.56 | 0.14 | 0.06 | 0.20 | 0.20 | 0.00 | 0.00 | 9.88 | 99.96% |
| Cis2-Butene | 9.88 | 1.00 | 8.88 | 1.00 | 0.00 | 1.07 | 0.07 | 0.03 | 0.10 | 0.10 | 0.00 | 0.00 | 9.88 | 99.99% |
| Tr2-Butene | 9.88 | 1.01 | 8.80 | 1.01 | 0.00 | 1.16 | 0.08 | 0.03 | 0.12 | 0.12 | 0.00 | 0.00 | 9.88 | 99.99% |
| Iso-Butane | 29.64 | 4.72 | 24.92 | 4.72 | 0.02 | 5.20 | 0.50 | 0.21 | 0.71 | 0.71 | 0.00 | 0.02 | 29.62 | 99.94% |
| N-Butane | 24.70 | 3.16 | 21.54 | 3.16 | 0.01 | 3.43 | 0.27 | 0.12 | 0.39 | 0.39 | 0.00 | 0.01 | 24.69 | 99.97% |
| Iso-Pentane | 4.94 | 0.21 | 4.73 | 0.21 | 0.00 | 0.21 | 0.01 | 0.00 | 0.01 | 0.01 | 0.00 | 0.00 | 4.94 | 100.00% |
| N-Pentane | 4.94 | 0.14 | 4.80 | 0.14 | 0.00 | 0.14 | 0.00 | 0.00 | 0.00 | 0.00 | 0.00 | 0.00 | 4.94 | 100.00% |
| N-Hexane | 14.82 | 0.10 | 14.72 | 0.10 | 0.00 | 0.10 | 0.00 | 0.00 | 0.00 | 0.00 | 0.00 | 0.00 | 14.82 | 100.00% |
| TOTAL | 3745.03 | 4257.52 | 683.10 | 4257.52 | 4333.26 | 821.16 | 896.93 | 384.4O | 1343.73 | 1343.73 | 62.39 | 4395.65 | 544.85 | |
| PRESSURE, PSIA | 185 | 300 | 300 | 125 | 115 | 120 | 290 | 350 | 295 | 292 | 115 | 110 | 300 | |
| TEMPERATURE, F. | 125 | −30 | −30 | −79 | −104 | −92 | −100 | -27 | 21 | -28 | -58 | 97 | 146 | |

TABLE 2

| COMPONENT | STREAM NUMBER 1 | 4 | 3-LIQ | 5 | 10A | 23A | 25A | 9 | 14 | 16 | 18 | 21 | 15 | PERCENT RECOVERY |
|---|---|---|---|---|---|---|---|---|---|---|---|---|---|---|
| | MOLS/HR | | | | | | | | | | | | | |
| Hydrogen | 4153.94 | 1.91 | 0.19 | 4151.85 | 0.29 | 0.26 | 0.26 | 4151.82 | 2.65 | 2.65 | 2.13 | 4153.94 | 0.00 | |
| Hydrogen Sulfide | 15.22 | 2.51 | 0.52 | 12.20 | 2.07 | 4.85 | 4.85 | 14.97 | 9.70 | 9.70 | 0.01 | 14.98 | 0.24 | |
| Methane | 646.95 | 6.71 | 1.03 | 639.21 | 2.88 | 9.65 | 9.65 | 645.98 | 20.28 | 20.28 | 0.98 | 646.95 | 0.00 | |
| Ethylene | 1.35 | 0.10 | 0.02 | 1.23 | 0.08 | 0.20 | 0.20 | 1.35 | 0.40 | 0.40 | 0.00 | 1.35 | 0.00 | 0.00% |
| Ethane | 420.37 | 58.06 | 13.08 | 349.23 | 54.57 | 122.91 | 122.91 | 417.62 | 246.14 | 246.14 | 0.31 | 417.93 | 2.53 | 0.60% |
| Propene | 22.49 | 10.50 | 2.49 | 9.50 | 9.04 | 0.30 | 0.30 | 0.76 | 0.61 | 0.61 | 0.00 | 0.76 | 21.73 | 96.63% |
| Propane | 129.36 | 69.26 | 15.73 | 44.37 | 44.39 | 0.63 | 0.63 | 0.60 | 1.25 | 1.25 | 0.00 | 0.60 | 128.76 | 99.54% |
| Iso-Butane | 11.33 | 9.33 | 1.27 | 0.72 | 0.72 | 0.00 | 0.00 | 0.00 | 0.00 | 0.00 | 0.00 | 0.00 | 11.33 | 100.00% |
| N-Butane | 16.57 | 14.74 | 1.40 | 0.43 | 0.43 | 0.00 | 0.00 | 0.00 | 0.00 | 0.00 | 0.00 | 0.00 | 16.57 | 100.00% |
| Iso-Pentane | 10.15 | 9.83 | 0.29 | 0.02 | 0.02 | 0.00 | 0.00 | 0.00 | 0.00 | 0.00 | 0.00 | 0.00 | 10.15 | 100.00% |
| N-Pentane | 7.10 | 6.97 | 0.13 | 0.00 | 0.00 | 0.00 | 0.00 | 0.00 | 0.00 | 0.00 | 0.00 | 0.00 | 7.10 | 100.00% |
| N-Hexane | 28.24 | 28.15 | 0.09 | 0.00 | 0.00 | 0.00 | 0.00 | 0.00 | 0.00 | 0.00 | 0.00 | 0.00 | 28.24 | 100.00% |
| TOTAL | 5463.06 | 218.07 | 36.23 | 5208.75 | 114.51 | 138.80 | 138.80 | 5233.10 | 281.04 | 281.04 | 3.43 | 5236.53 | 226.64 | |
| PRESSURE, PSIA | 234 | 305 | 190 | 110 | 165 | 163 | 165 | 108 | 110 | 107 | 105 | 102 | 115 | |
| TEMPERATURE, F. | 104 | −66 | −100 | −131 | −131 | −141 | −141 | −144 | −45 | −141 | −141 | 82 | 85 | |

TABLE 3

| COMPONENT | STREAM NUMBER 1 | 4 | 5 | 9 | 10 | 23A | 25 | 14 | 16 | 18 | 21 | 15 | PERCENT RECOVERY |
|---|---|---|---|---|---|---|---|---|---|---|---|---|---|
| | MOLS/HR | | | | | | | | | | | | |
| Hydrogen | 293.96 | 1.09 | 292.87 | 292.80 | 0.25 | 0.17 | 0.07 | 1.41 | 1.41 | 1.16 | 293.96 | 0.00 | |
| Nitrogen | 87.80 | 0.86 | 86.94 | 86.97 | 0.30 | 0.33 | 0.14 | 1.31 | 1.31 | 0.83 | 87.80 | 0.00 | |
| Oxygen | 1.49 | 0.03 | 1.46 | 1.46 | 0.02 | 0.02 | 0.01 | 0.06 | 0.06 | 0.03 | 1.49 | 0.00 | |

TABLE 3-continued

| COMPONENT | STREAM NUMBER 1 | 4 | 5 | 9 | 10 | 23A | 25 | 14 | 16 | 18 | 21 | 15 | PERCENT RECOVERY |
|---|---|---|---|---|---|---|---|---|---|---|---|---|---|
| | MOLS/HR | | | | | | | | | | | | |
| Methane | 420.67 | 16.77 | 403.90 | 409.78 | 8.88 | 14.77 | 6.33 | 31.99 | 31.99 | 10.89 | 420.67 | 0.00 | |
| Ethylene | 200.29 | 40.63 | 159.66 | 189.09 | 41.78 | 71.20 | 30.52 | 112.90 | 112.90 | 11.18 | 200.27 | 0.02 | 0.01% |
| Ethane | 198.91 | 61.23 | 137.68 | 185.29 | 85.52 | 133.14 | 57.06 | 203.03 | 203.03 | 12.83 | 198.13 | 0.77 | 0.39% |
| Propene | 152.94 | 101.61 | 51.33 | 3.11 | 66.95 | 18.72 | 8.02 | 27.22 | 27.22 | 0.48 | 3.59 | 149.35 | 97.65% |
| Propane | 26.37 | 18.38 | 7.99 | 0.31 | 10.07 | 2.38 | 1.02 | 3.46 | 3.46 | 0.05 | 0.36 | 26.01 | 98.64% |
| Iso-Butene | 5.21 | 4.70 | 0.51 | 0.00 | 0.55 | 0.04 | 0.02 | 0.06 | 0.06 | 0.00 | 0.00 | 5.21 | 99.98% |
| 1-Butene | 5.15 | 4.67 | 0.48 | 0.00 | 0.52 | 0.04 | 0.02 | 0.05 | 0.05 | 0.00 | 0.00 | 5.15 | 99.98% |
| Cis2-Butene | 2.96 | 2.77 | 0.19 | 0.00 | 0.20 | 0.01 | 0.00 | 0.02 | 0.02 | 0.00 | 0.00 | 2.96 | 99.99% |
| Tr2-Butene | 4.72 | 4.39 | 0.33 | 0.00 | 0.35 | 0.02 | 0.01 | 0.03 | 0.03 | 0.00 | 0.00 | 4.72 | 99.99% |
| Iso-Butane | 18.25 | 16.43 | 1.82 | 0.00 | 1.97 | 0.15 | 0.07 | 0.22 | 0.22 | 0.00 | 0.00 | 18.25 | 99.97% |
| N-Butane | 3.48 | 3.19 | 0.29 | 0.00 | 0.32 | 0.02 | 0.01 | 0.03 | 0.03 | 0.00 | 0.00 | 3.48 | 99.98% |
| Iso-Pentane | 1.82 | 1.77 | 0.05 | 0.00 | 0.05 | 0.00 | 0.00 | 0.00 | 0.00 | 0.00 | 0.00 | 1.82 | 100.00% |
| N-Hexane | 3.30 | 3.29 | 0.01 | 0.00 | 0.01 | 0.00 | 0.00 | 0.00 | 0.00 | 0.00 | 0.00 | 3.30 | 100.00% |
| TOTAL | 1427.32 | 281.81 | 1145.51 | 1168.81 | 217.72 | 241.02 | 103.30 | 381.78 | 381.78 | 37.46 | 1206.27 | 221.03 | |
| PRESSURE, PSIA | 165 | 250 | 98 | 88 | 93 | 255 | 315 | 260 | 257 | 88 | 80 | 265 | |
| TEMPER-ATURE, F. | 105 | −36 | −86 | −115 | −100 | −112 | −29 | 11 | −30 | −61 | 95 | 130 | |

TABLE 4

| COMPONENT | STREAM NUMBER 1 | 4 | 5 | 9 | 10 | 24 | 25 | 14 | 16 | 18 | 21A | 15 | PERCENT RECOVERY |
|---|---|---|---|---|---|---|---|---|---|---|---|---|---|
| | MOLS/HR | | | | | | | | | | | | |
| Nitrogen | 99.17 | 1.22 | 97.95 | 97.51 | 0.80 | 0.36 | 0.36 | 2.38 | 2.38 | 1.66 | 99.17 | 0.00 | |
| Carbon Dioxide | 8.64 | 0.90 | 7.74 | 8.20 | 1.31 | 1.77 | 1.77 | 3.98 | 3.98 | 0.44 | 8.64 | 0.00 | |
| Methane | 7552.91 | 300.68 | 7252.23 | 7250.89 | 290.15 | 288.81 | 288.79 | 879.66 | 879.66 | 302.08 | 7552.97 | 0.00 | |
| Ethane | 486.41 | 99.78 | 388.63 | 455.19 | 190.66 | 259.22 | 259.18 | 539.83 | 539.83 | 21.47 | 476.66 | 9.82 | 2.02% |
| Propane | 198.31 | 97.55 | 100.76 | 1.72 | 105.28 | 6.24 | 6.26 | 12.60 | 12.60 | 0.08 | 1.80 | 196.49 | 99.08% |
| Iso-Butane | 36.66 | 25.90 | 10.76 | 0.00 | 10.77 | 0.01 | 0.01 | 0.03 | 0.03 | 0.00 | 0.00 | 36.66 | 100.00% |
| N-Butane | 63.30 | 49.38 | 13.92 | 0.00 | 13.92 | 0.00 | 0.00 | 0.01 | 0.01 | 0.00 | 0.00 | 63.30 | 100.00% |
| Iso-Pentane | 20.83 | 18.66 | 2.17 | 0.00 | 2.17 | 0.00 | 0.00 | 0.00 | 0.00 | 0.00 | 0.00 | 20.83 | 100.00% |
| N-Pentane | 20.63 | 19.07 | 1.56 | 0.00 | 1.56 | 0.00 | 0.00 | 0.00 | 0.00 | 0.00 | 0.00 | 20.63 | 100.00% |
| N-Hexane | 19.29 | 18.81 | 0.48 | 0.00 | 0.48 | 0.00 | 0.00 | 0.00 | 0.00 | 0.00 | 0.00 | 19.29 | 100.00% |
| N-Heptane | 12.32 | 12.22 | 0.10 | 0.00 | 0.10 | 0.00 | 0.00 | 0.00 | 0.00 | 0.00 | 0.00 | 12.32 | |
| N-Nonane | 8.63 | 6.62 | 0.01 | 0.00 | 0.01 | 0.00 | 0.00 | 0.00 | 0.00 | 0.00 | 0.00 | 6.63 | |
| TOTAL | 8525.10 | 650.80 | 7874.30 | 7813.52 | 617.20 | 556.42 | 556.37 | 1438.48 | 1438.48 | 325.73 | 8139.24 | 385.97 | |
| PRESSURE, PSIA | 370 | 737 | 359 | 352 | 354 | 369 | 410 | 355 | 353 | 349 | 417 | 360 | |
| TEMPER-ATURE, F. | 120 | −46 | −103 | −114 | −106 | −111 | −109 | −31 | −110 | −110 | 151 | 203 | |

We claim:

1. In a process for separation of a gas stream containing methane, $C_2$ components, $C_3$ components and heavier hydrocarbon components into a volatile residue gas fraction and a relatively less volatile fraction containing said $C_3$ components and heavier hydrocarbon components, in which process (a) the feed gas is cooled in one or more heat exchangers providing thereby a first residue vapor and a first $C_3$ containing liquid which liquid also contains lighter hydrocarbons; and (b) a portion of the first $C_3$ containing liquids is directed into a heavy ends fractionation column wherein said liquid is separated into a second residue containing lighter hydrocarbons and a $C_3$ containing product;

the improvements comprising;

(1) cooling said second residue to condense at least a portion thereof into a $C_2$ containing liquid stream and a fourth residue vapor;

(2) separating the fourth residue vapor produced in step (1) from the $C_2$ containing liquid stream;

(3) further cooling at least a part of the said $C_2$ containing liquid;

(4) intimately contacting at least part of the said first residue vapors with at least part of the said cooled $C_2$ containing liquid in a fractionation device having at least one contacting stage and thereafter separating a third residue vapor and a resulting second $C_3$ containing liquid from said fractionation device;

(5) supplying the liquids thereby recovered into heat exchange relation with said $C_2$ containing liquid stream to supply a portion of the cooling of step (3) and thereafter into the heavy ends fractionation column as a feed thereto;

(6) supplying the fourth residue vapors thereby recovered into heat exchange relation with said $C_2$ containing liquid stream to supply a portion of the cooling of step (3) and thereafter discharging said residue gases.

2. The improvement according to claim 1 wherein said contacting step (4) is carried out in a light ends fractionation column that includes fractionation means for vapor/liquid counter-current contact and (i) wherein said cooled $C_2$ containing liquid is introduced into said light end fractionation column above said fractionation means, whereby the cooled $C_2$ containing liquid passes downwardly through said fractionation means;

(ii) supplying at least part of the first residue vapors to said light ends fractionation column below said fractionation means, whereby the first residue vapor rises through said fractionation means in counter-current contact with the cooled $C_2$ containing liquid.

3. The improvement according to claim 2 wherein the fractionation means in said light ends fractionation column provides the equivalent of at least one theoretical distillation stage arranged to contact at least part of said first residue vapors with the $C_2$ containing liquid stream.

4. The process of claim 1 including the step of cooling the $C_2$ containing liquid from step (2) prior to delivery of the $C_2$ containing liquid to the light ends fractionation column.

5. The process of claim 1 including the step of directing the fourth residue recovered from the light ends fractionation column into heat exchange relation with said $C_2$ containing liquid stream.

6. The process of claim 1 including the step of directing the second $C_3$ containing liquid recovered from the light ends fractionation column into heat exchange relation with said $C_2$ containing liquid stream.

7. The process of claim 1 including the step of combining the third and fourth residue gases prior to their discharge.

8. An apparatus for separating a feed gas containing at least methane, $C_2$ components and $C_3$ components into a fraction containing a predominant portion of $C_2$ and lighter components and a fraction containing a predominant portion of the $C_3$ and heavier components, comprising:

(a) separator means for receiving feed gas and for providing at a first outlet a first residue vapor and at a second outlet a $C_3$ containing liquid which liquid also contains lighter hydrocarbons;

(b) a heavy ends fractionation column means connected to receive at least a portion of said $C_3$ containing liquids, the heavy ends fractionation column means being adapted to separate the $C_3$ containing liquids into a second residue containing lighter hydrocarbons and a $C_3$ containing liquid product;

(c) heat exchanger system to cool and at least partially condense the second residue from the heavy ends fractionation column into a possible third residue and a $C_2$ containing liquid stream;

(d) heat exchange system to further cool the $C_2$ containing liquids;

(e) light ends fractionation column means connected to receive at least part of said first residue vapors and at least part of the said cooled $C_2$ containing liquids and to co-mingle said vapor and liquid in at least one contacting stage, and including the separation means for separating the vapor and liquid after contact in said stage, and being further connected to supply, via heat exchange, the liquids separated therein to said heavy ends fractionation column as a feed thereto.

9. The apparatus according to claim 8 wherein said light ends fractionation column includes fractionation means for counter-current vapor-liquid contact and wherein said light ends fractionation column is connected to receive the portion of said first residue vapors to be treated therein below said fractionation means and to receive the portion of said cooled $C_2$ containing liquids above said fractionation means, said fractionation means thereby being adapted so that the first residue vapors rise there-through in counter-current contact with cooled $C_2$ containing liquids.

10. The apparatus according to claim 9 wherein said fractionation means in said light ends fractionation column includes vapor-liquid contacting means which are the equivalent of at least one theoretical distillation stage.

11. An apparatus according to claim 8 including expansion means connected to receive first residue from said separator means having means to reduce the pressure of and reduce the temperature of the first residue before the same is directed into said light ends fractionation column.

12. An apparatus according to claim 8 wherein the heat exchange system includes a heat exchange means connected to receive said $C_2$ containing liquids and cool them.

13. An apparatus according to claim 12 wherein said heat exchange means connected to receive said $C_2$ containing liquids and cool them includes an arrangement wherein said light ends fractionation column means is connected to direct fourth residue vapors therein through said heat exchange means.

14. An apparatus according to claim 12 wherein said heat exchange means connected to receive said $C_2$ containing liquids and cool them includes an arrangement wherein said light ends fractionation column means is connected to direct second $C_3$ containing liquids therein through said heat exchange means.

* * * * *